United States Patent [19]

Gold

[11] Patent Number: 4,673,111

[45] Date of Patent: Jun. 16, 1987

[54] NUT DISPENSING MACHINE

[75] Inventor: Arthur Gold, Northbrook, Ill.

[73] Assignee: Carousel Industries, Inc., Morton Grove, Ill.

[21] Appl. No.: 838,804

[22] Filed: Mar. 12, 1986

[51] Int. Cl.[4] ..... G01F 11/10

[52] U.S. Cl. ..... 222/305; 222/362; 222/408.5; 221/264

[58] Field of Search ..... 222/243, 226, 344, 355, 222/361, 408.5, 409, 444, 108, 362, 363, 366, 305, 307, 308; 221/263, 264, 266; 366/184, 189, 332, 344

[56] References Cited

U.S. PATENT DOCUMENTS

| | | | |
|---|---|---|---|
| 969,330 | 9/1910 | Bloch | 222/243 X |
| 1,931,908 | 10/1933 | Tillotson | 222/243 |
| 2,329,431 | 9/1943 | Bowman | 222/243 |
| 2,852,167 | 9/1958 | Lempart | 222/361 X |
| 4,004,719 | 1/1977 | Weitzman | 222/361 X |
| 4,440,322 | 4/1984 | Henry | 222/361 X |

*Primary Examiner*—Joseph J. Rolla
*Assistant Examiner*—David H. Bollinger
*Attorney, Agent, or Firm*—Silverman, Cass, Singer & Winburn

[57] ABSTRACT

A nut dispensing machine which includes a nut receptacle mounted onto a base which includes a nut dispensing mechanism which is designed to prevent jamming or binding. The mechanism includes a nut dispensing slide having a dispensing opening reciprocally mounted in the base on a support platform. The platform has an obstruction clearing opening therein through which obstructions fall to clear the dispensing slide. The slide includes a mixing post mounted thereon which extends into the receptacle to assist in dispensing the nuts.

11 Claims, 7 Drawing Figures

FIG. 1
PRIOR
ART
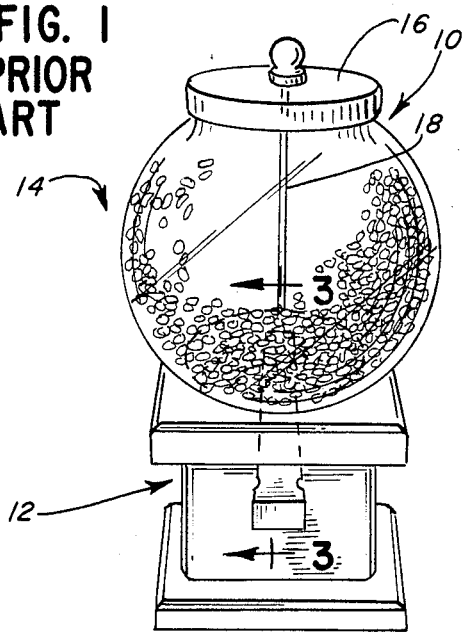
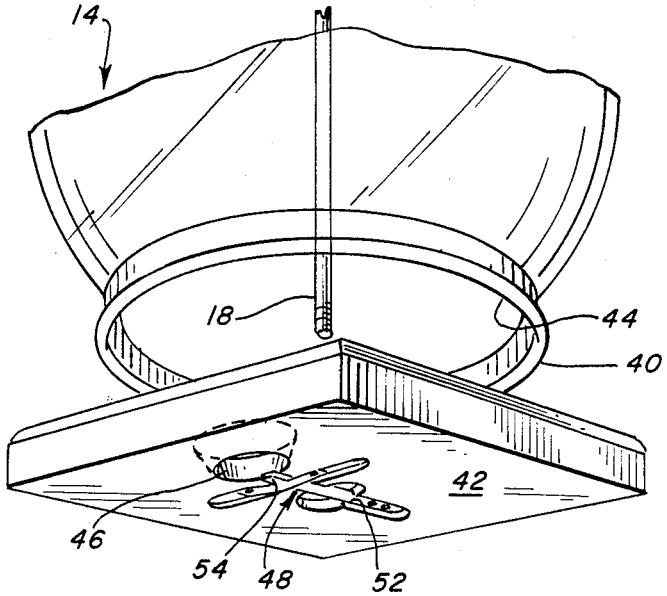
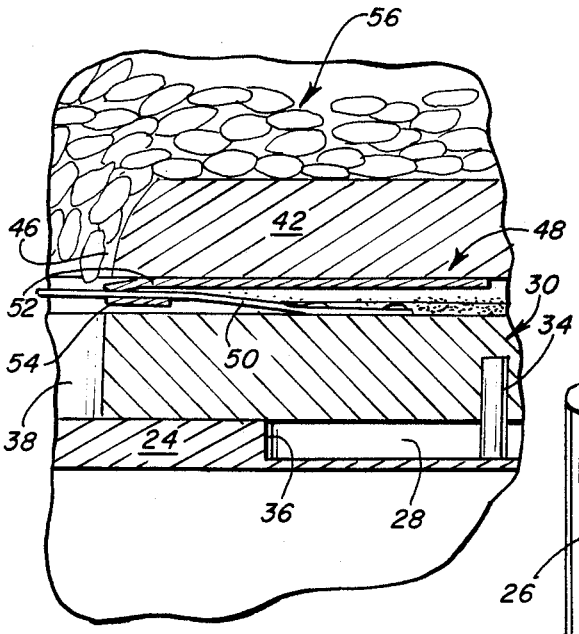
FIG. 3
PRIOR ART
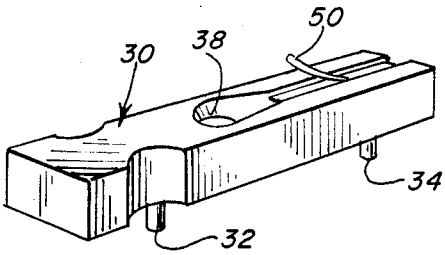
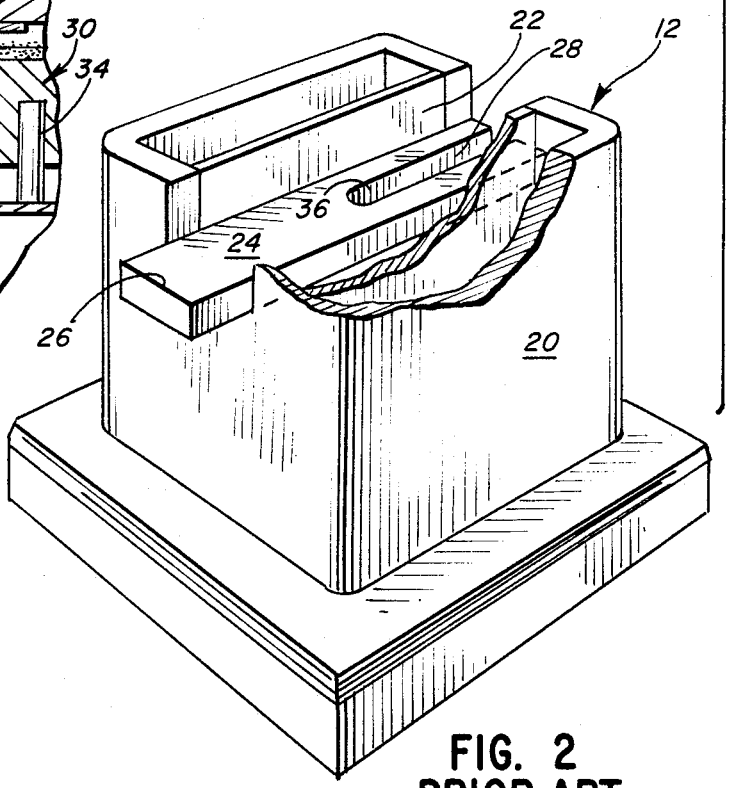
FIG. 2
PRIOR ART FIG. 4
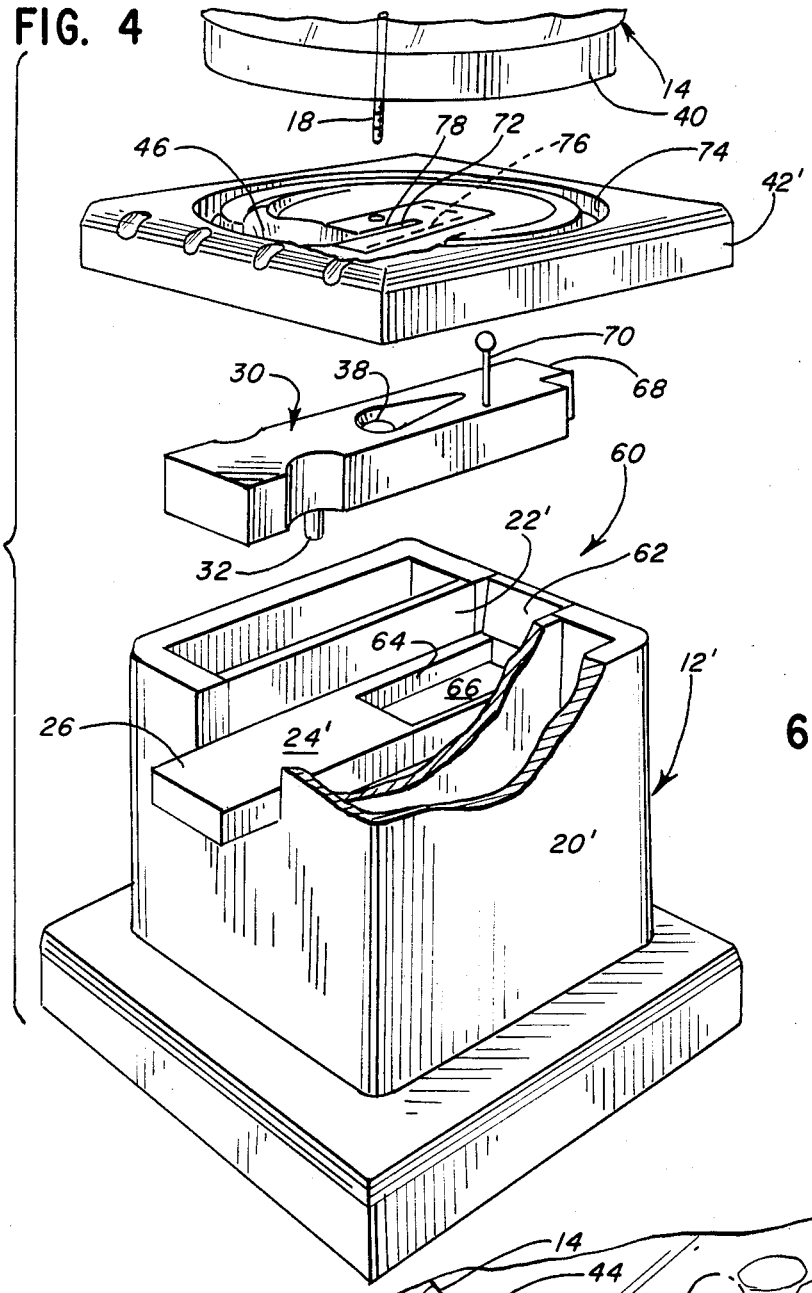
FIG. 5
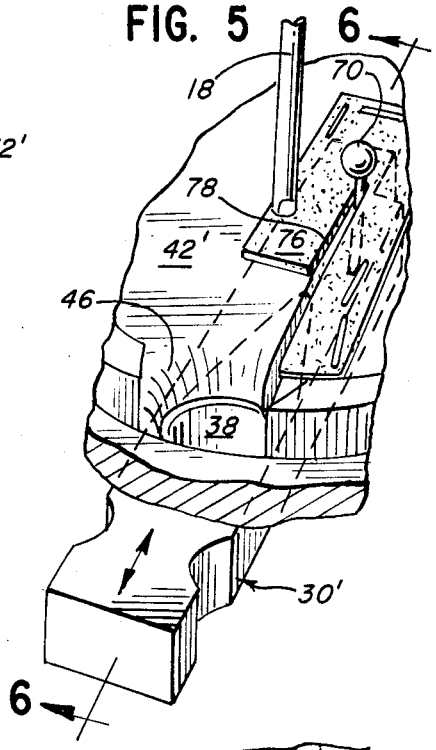
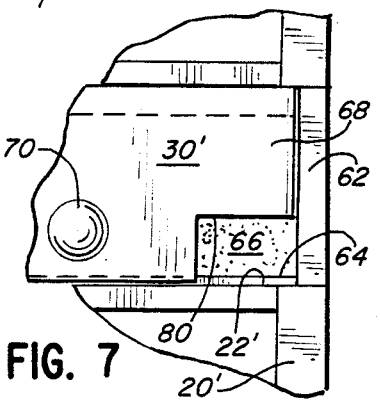
FIG. 7
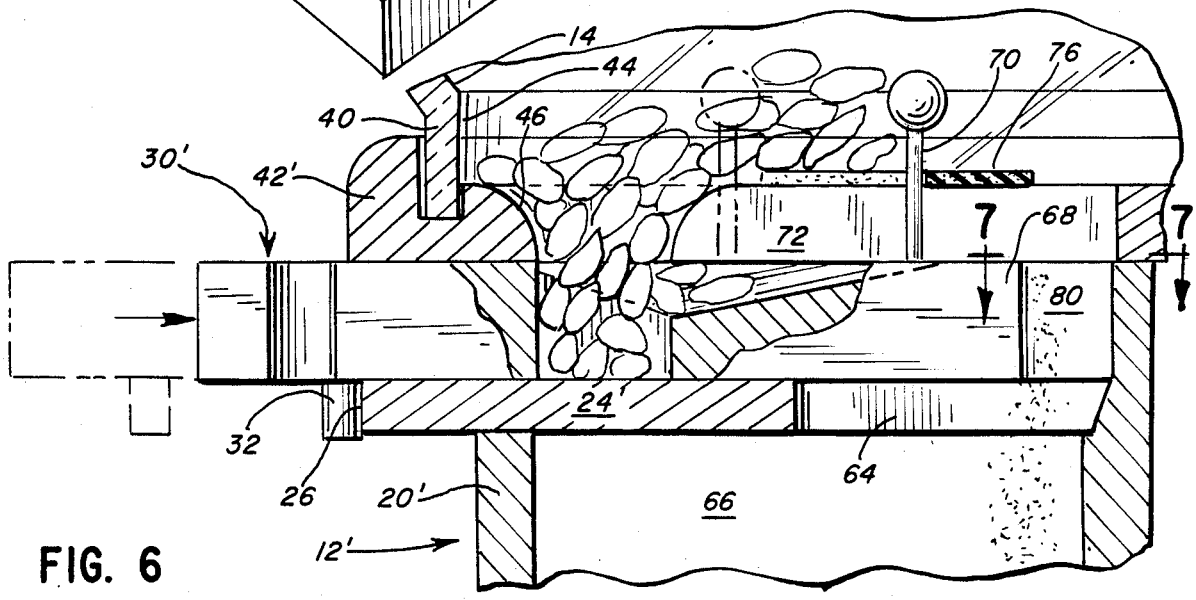
FIG. 6

NUT DISPENSING MACHINE

BACKGROUND OF THE INVENTION

The invention relates generally to the dispensing of nuts or other similar edible products and more particularly, to a nut dispensing machine for easily dispensing nuts therefrom without jamming or otherwise becoming difficult to operate.

Any number of nut dispensing systems and apparatuses have been utilized to dispense nuts or other objects. These systems have included very complex mechanisms and often have included coin-operated dispensing devices.

One particular non-coin operated device has been previously utilized by applicant. This nut dispensing machine was formed from wood to provide an attractive, but relatively uncomplicated design for a nut dispensing mechanism. A serious problem has arisen in utilizing this nut dispensing mechanism because the design thereof did not allow for automatic clearing of obstructions, such as particles or fragments of the nuts dispensed thereby. The nut dispensing mechanism, therefore, can bind or jam or just become difficult to operate. Under such adverse situations, the nut dispensing machine was essentially inoperative and not readily repairable at all, by the ordinary user thereof. This necessitated return of the machine to the manufacturer with attendant cost and possible customer dissatisfaction.

SUMMARY OF THE INVENTION

The above and other disadvantages of prior art nut dispensing systems are overcome in accordance with the present invention by providing a nut dispensing slide which communicates with a clearance opening into the well in the base of the nut dispensing machine to clear obstructions from the dispensing slide without jamming or binding of the slide. The invention includes a nut receptacle or globe mounted onto the base and communicating with a nut dispensing opening in the slide. The slide is reciprocally mounted in the base on a support platform which includes the obstruction clearing opening therein. When the slide is reciprocated, the obstructions, such as nut fragments or particles, are pushed into the opening where they fall into the well in the base. The nut receptacle or globe can be mounted on a mounting plate mounted on the base, which has an opening communicating with the slide dispensing opening in a first position and includes a slot opening into the plate opening. A mixing post is mounted on the slide and is reciprocated through the slot to assist in the dispensing of the nuts.

BRIEF DESCRIPTION OF THE DRAWINGS

FIG. 1 is a perspective view of applicant's prior art nut dispensing machine;

FIG. 2 is an exploded perspective view of the machine of FIG. 1;

FIG. 3 is a partial side sectional view of the nut dispensing slide of the machine of FIG. 1 along the line 3—3;

FIG. 4 is an exploded perspective view of one embodiment of the present invention;

FIG. 5 is a partial perspective view of one embodiment of the nut dispensing slide of the present invention;

FIG. 6 is a partial side sectional view of the nut dispensing slide of FIG. 5 along line 6—6; and FIG. 7 is a partial top plan view of the slide of FIG. 6 along line 7—7.

DESCRIPTION OF THE PREFERRED EMBODIMENTS

Referring to FIGS. 1 and 2, applicant's prior art nut machine is designated generally by the reference numeral 10. The machine 10 includes a base 12 and a nut receptacle 14 mounted thereon. The nut recetacle 14 is adapted to hold a plurality of nuts, or other similar objects such as jelly beans or gum balls.

The receptacle 14 includes a lid 16 which preferably is mounted on a retaining post 18 and is easily removed therefrom by unscrewing the lid 16 to fill the receptacle 14. The base 12 preferably includes a bottom unit or stand 20 having a sealed recess 22 including a support platform 24 forming the bottom of the recess 22. The support platform 24 preferably extends outwardly on one end 26 away from the stand 20 to aid in dispensing the nuts free of the stand 20.

The support platform 24 also includes a slot 28 formed in an upper position therein to provide a stop for a dispensing slide 30. The slide 30 is reciprocably mounted on the platform 24 and includes a pair of stop posts 32 and 34. The post 32 abuts the end 26 of the platform 24 in a first closed or loading position. In a second dispensing position, the post 34 abuts a closed end 36 of the slot 28. The slide 30 includes a dispensing opening or well 38, sized to accommodate the amount of nuts desired to be dispensed with each operation of the machine 10.

The nut receptacle 14 preferably includes a lower rim 40 which is mounted into a recess (not illustrated) in a base mounting plate 42. The receptacle 14 includes an opening 44, which registers with an opening 46 in the plate 42. The post 18 preferably is mounted in the plate 42.

Referring to FIGS. 2 and 3, the plate 42 also includes a guide mechanism 48 for guiding a resilient mixing finger 50 mounted on the slide 30 into and through the opening 46 into the opening 44 when the slide is reciprocated. The guide mechanism 48 includes a slide piece 52 and a guide member 54 spaced therefrom. When the slide 30 is reciprocated, the finger 50 slides along the slide 52 and is guided above the member 54 into the opening 46 and 44 to mix and agitate the nuts 56 to assist the nuts in filling the opening 38.

The support platform 24 and the slide 30 form a dispensing mechanism with the plate 42. In utilizing this mechanism, applicant has discovered that fragments or particles of the nuts or other edible products to be dispensed become trapped between the recess 22 and the slide 30, which can bind or jam the dispensing mechanism. The only solution is to then disassemble the machine 10 so that the slide 30 and recess 22 can be cleared of the obstructions. This procedure is time consuming and typically becomes necessary when the proprietor is most busy. Further, the plate 42 preferably is permanently attached to the base 20, such as by adhesive, such that it is difficult to disassemble.

To eliminate the jamming/binding problem as well as to provide a better mixing and dispensing of the nuts, applicant developed the present invention designated generally by the reference numeral 60 in FIGS. 4–7. Referring to FIGS. 4–7, the nut machine 60 of the present invention is best illustrated with the same or similar parts as those in the machine 10 referred to with the same numerals primed. The machine 60 includes a base 12' and a nut receptacle 14 mounted thereon by a retaining post 18.

The base 12' includes a base stand 20' with a recess 22' formed therein. The recess 22' includes a support platform 24' and a closed end wall 62. The platform 24' and a closed end wall 62. The platform 24' includes an obstruction clearing opening 64 therethrough which allows obstructions, such as nut particles, to fall through the opening 64 into a well 66 in the stand 20'.

A slide 30' is reciprocally mounted on the platform 24' in the recess 22'. The post 32 again abuts the end 26 of the platform 24' in the closed or loading position. The post 32 could be eliminated, with the opposite end 68 of the slide 30' abutting the wall 62 to provide the loading position. The slide 30' includes an upstanding mixing post 70 mounted therein. The mixing post 70 extends through a slot 72 in a mounting plate 42' into the receptacle 14. The slot 72 communicates with the opening 46 and the post 70 is reciprocated through the slot 72 and the opening 46 as the slide 30' is reciprocated to mix the nuts and assist in the dispensing the nuts through the opening 46.

The plate 42' includes a recess 74 around the periphery thereof into which the rim 40 of the receptacle 14 is mounted. The slot 72 preferably includes a flexible member or membrane 76 which is mounted on the plate 42'. The membrane 76 includes a slit 78 aligned with the slot 72, which allows the post 70 to be reciprocated therethrough, but prevents the nuts or other obstructions from falling into the slot 72.

Referring to FIGS. 6 and 7, the slide 30' includes a recess 80 in the end 68 which communicates with the opening 64 to assist in removing obstructions from the slide 30' and the recess 22'. Further, in the dispensing position the recess 80 communicates with the slot 72 allowing any obstructions in the slot 72 to also be removed when the slide 30' is returned to the loading position. The slide 30', the recess 22' and the plate 42' combine to provide an improved dispensing mechanism which does not jam as readily as the mechansim of the machine 10 and further provides, with the mixing post 70, a better mixing and dispensing of the nuts with a less complex mechanism.

Modifications and variations of the present invention are possible in light of the above teachings. The post 32, as above-mentioned, could be eliminated. The major parts of the machine 60, the base 12', the slide 30' and the plate 42' preferably are formed from wood, as in the machine 10, however, other materials such a plastic also can be utilized. It is therefore to be understood that within the scope of the appended claims the invention can be practiced otherwise than as specifically claimed.

What is claimed and desired to be secured by Letters Patent of the United States is:

1. A nut dispensing machine comprising:

a base;

a nut receptacle mounted on said base adapted to hold a plurality of nuts or other objects to be dispensed therein; and nut dispensing means mounted in said base and communicating with an opening in said nut receptacle for dispensing nuts from said opening when said dispensing means are actuated, said dispensing means including an elongated slide reciprocally mounted on a support platform in a recess formed in said base and having a first end extending from said base for grasping to reciprocate said slide, said slide including a dispensing opening therethrough communicating on one side with said receptacle opening at a first position of said slide and communicating on the second side outside said platform to dispense the nuts or other objects from said nut receptacle, said slide including a recess at the second end of said slide which communicates with said obstruction clearing opening to assist in clearing obstructions from said dispensing means, said support platform having an opening therethrough into a well in said base for clearing obstructions from said dispensing means, which opening does not communicate with said slide dispensing opening.

2. The apparatus as defined in claim 1 wherein said base includes a mounting plate on top of said base and said nut dispensing means into which said nut receptacle is mounted, said mounting plate including a recess around the periphery thereof into which a bottom rim of said nut receptacle is mounted and an opening through said mounting plate which communicates with said nut receptacle opening and with said dispensing opening when said slide is in said first position and a slot communicating with said plate opening; and said slide including a mixing post mounted therein which extends through said slot and is reciprocal with said slide along said slot into said plate opening and said post having an upper end extending through said plate into said receptacle to agitate and mix the nuts to assist the dispensing thereof.

3. The apparatus as defined in claim 2 wherein said base, said nut dispensing means including said slide and said mounting plate are formed from wood.

4. The apparatus as defined in claim 2 wherein said slot is covered by a flexible member to prevent said nuts from entering the slot, but allowing said post to reciprocate through said slot.

5. An improved nut dispensing machine, the machine including a base having a mounting plate on top of the base, the mounting plate including a recess around the periphery thereof and an opening therethrough, a nut receptacle mounted on the mounting plate and the receptacle including a bottom rim mounted into the recess and a nut receptacle opening which communicates with the mounting plate opening, the receptacle adapted to hold a plurality of nuts or other objects to be dispensed therein, and nut dispensing means mounted in the base and communicating with the opening in the nut receptacle for dispensing nuts from the opening when the dispensing means are actuated, the dispensing means including an elongated slide reciprocally mounted on a support platform in a recess formed in the base and having a first end extending from the base for grasping to reciprocate the slide, the slide including a dispensing opening therethrough communicating on one side with the receptacle opening at a first position of the slide and communicating on the second side outside the platform to dispense the nuts or other objects from the nut receptacle, said improvement comprising:

said support platform having an opening therethrough into a well formed in said base for clearing obstructions from said dispensing means, which opening does not communicate with said slide dispensing opening;

said mounting plate including a slot communicating with said plate opening, said slot covered by a flexible member to prevent said nuts from entering the slot, but allowing a post to be reciprocated through said slot; and said slide including a mixing post mounted therein which extends through said slot and is reciprocal with said slide along said slot into said plate opening and said post having an upper end extending through said slot and said plate into said receptacle to agitate and mix the nuts to assist the dispensing thereof.

6. The improvement as defined in claim 5 wherein said base, said nut dispensing means including said slide and said mounting plate are formed from wood.

7. The improvement as defined in claim 5 wherein said slide includes a recess at the second end of said slide, which communicates with said slot and with said obstruction clearing opening to assist in clearing obstructions from said dispensing means.

8. A nut dispensing machine comprising:

a base;

a nut receptacle mounted on said base adapted to hold a plurality of nuts or other objects to be dispensed therein; and nut dispensing means mounted in said base and communicating with an opening in said nut receptacle for dispensing nuts from said opening when said dispensing means are actuated, said dispensing means including an elongated slide reciprocally mounted on a support platform in a recess formed in said base and having a first end extending from said base for grasping to reciprocate said slide, said slide including a dispensing opening therethrough communicating on one side with said receptacle opening at a first position of said slide and communicating on the second side outside said platform to dispense the nuts or other objects from said nut receptacle, said support platform having an opening therethrough into a well in said base for clearing obstruction from said dispensing means, which opening does not communicate with said slide dispensing opening, said opening being substantially the width of said slide and which opening remains covered by said slide to prevent communication between said opening and said slide dispensing opening to clear obstructions while preventing nuts to be dispensed from falling through said opening into said base well and said slide including a recess at the second end of said slide which communicates with said obstruction clearing opening to assist in clearing obstructions from said dispensing means.

9. The apparatus as defined in claim 8 wherein said base includes a mounting plate on top of said base and said nut dispensing means into which said nut receptacle is mounted, said mounting plate including a recess around the periphery thereof into which a bottom rim of said nut receptacle is mounted and an opening through said mounting plate which communicates with said nut receptacle opening and with said dispensing opening when said slide is in said first position and a slot communicating with said plate opening; and said slide including a mixing post mounted therein which extends through said slot and is reciprocal with said slide along said slot into said plate opening and said post having an upper end extending through said plate into said receptacle to agitate and mix the nuts to assist the dispensing thereof.

10. The apparatus as defined in claim 9 wherein said base, said nut dispensing means including said slide and said mounting plate are formed from wood.

11. The apparatus as defined in claim 9 wherein said slot is covered by a flexible member to prevent said nuts from entering the slot, but allowing said post to reciprocate through said slot.

* * * * *